United States Patent [19]

Hill

[11] Patent Number: 4,762,304

[45] Date of Patent: Aug. 9, 1988

[54] FLUID-OPERATED DOOR OPENER

[75] Inventor: Anthony Hill, Cradley Heath, England

[73] Assignee: Stafford Hill Arms Company Limited, Cradley Heath, England

[21] Appl. No.: 40,829

[22] Filed: Apr. 21, 1987

[30] Foreign Application Priority Data

Apr. 26, 1986 [GB] United Kingdom ..... 8610257

[51] Int. Cl.[4] ..... B66F 3/24

[52] U.S. Cl. ..... 254/93 R; 254/100; 29/239; 72/705

[58] Field of Search ..... 254/39, 93 R, 100; 29/239; 72/381, 399, 453.02, 705

[56] References Cited

U.S. PATENT DOCUMENTS

| | | | |
|---|---|---|---|
| 1,988,840 | 1/1935 | Hartl | 254/104 |
| 2,984,072 | 5/1961 | Born | 254/93 R |
| 3,014,696 | 12/1961 | Trott | 254/93 R |
| 3,376,795 | 4/1968 | Allen | 254/93 R |
| 4,270,733 | 6/1981 | DePue | 254/93 R |
| 4,657,225 | 4/1987 | Hoehn et al. | 72/705 |
| 4,660,806 | 4/1987 | Masters | 254/93 R |

*Primary Examiner*—Frederick R. Schmidt
*Assistant Examiner*—Judy J. Hartman
*Attorney, Agent, or Firm*—Roylance, Abrams, Berdo & Goodman

[57] ABSTRACT

The opener consists of two hydraulic actuators which are adapted to act along in two different directions in an horizontal plane, one of said directions being parallel or substantially parallel to the surface of the closed and locked door which is to be opened and the other direction being normal to said door surface. Jamb-engaging elements are associated with a first of the actuators, operation of said actuator causing the elements to engage the door jambs very firmly; operation of the second of the actuators pushes the closed/locked door inwardly out of the door frame.

1 Claim, 3 Drawing Sheets

FLUID-OPERATED DOOR OPENER

FIELD OF THE INVENTION

This invention relates to fluid-operated door opener.

BACKGROUND OF THE INVENTION

In many fields nowadays, there are circumstances in which rapid and quiet entry to closed and locked premises is required. Some of the authorities who need or might need to make such entry are police, customs and excise personnel, bailiffs, firemen and (in non-civilian circumstances) personnel in the armed forces.

In the field of drug-taking and drug-dealing, it has been common (at least in the United Kingdom) for personnel from the respective agency to approach the premises as quietly as possible and then to smash the door down if it proved to be securely locked in order to prevent entry. By the time the door was down, the drugs (which the personnel had hoped to seize and to use as evidence of illegal use and/or dealing) could well have been washed away down a water closet or down a sink whose taps were left running. Thus, a combination of the noise created in smashing down the door and the time taken to do it gives criminals valuable time within which to get rid of some or all of incriminating evidence.

BRIEF SUMMARY OF THE INVENTION

Nothing in the way of prior art is known to me which will do the required job in the optimum manner and, therefore, the principal aim of the present invention is to provide a door opener which is reasonably cheap to manufacture, is portable, and is capable of doing the job quickly and quietly. Accordingly, the present invention consists in a door opener which comprises first fluid-operated means operable to mount a second fluid-operated means securely on the jambs of a door frame in such a manner as to permit the door, which is connected to said door frame by hinge means and by locking means, to be moved relatively to said door frame by force (pressure) applied to the door by said mounted second fluid-operated means.

In a door opener as described in the preceding paragraph, the first fluid-operated means may be a piston/-cylinder device whose cylinder is connected to a frame whose free end constitutes a first jamb-engaging element and whose piston is connected to a rod whose free end is connected to a second jamb-engaging element, displacement of said piston in a first direction of movement thereof along the cylinder under the influence of a fluid at super-atmospheric pressure causing pressure to be applied to the opposed faces of the jambs by said jamb-engaging elements.

In a door opener as described in the preceding paragraph, said second fluid-operated means is secured to said frame. Preferably, said second fluid-operated means is secured to said frame at a location thereon which is as close as possible to said first jamb-engaging element.

In a door opener as described in any of the three preceding paragraphs, said second fluid-operated means may be a piston/cylinder device whose piston is connected to a rod whose free end applies said force (pressure) to the door when said piston is displaced in a first direction of movement thereof along the cylinder under the influence of a fluid at super-atmospheric pressure. Preferably, a plate is attached to said free end of the piston rod of the second fluid-operated means in order to spread the applied force (pressure) over an area of the door larger than the cross-sectional area of the piston rod.

A door opener as described in any one of the four preceding paragraphs will preferably include valve means connected to each of said first and said second fluid-operated means and to a hand-operated pump and reservoir of hydraulic oil. Alternatively, the arrangement described in the preceding sentence could be modified by substituting a battery-driven pump for the hand-operated pump, in which case the door opener will further include a source of electrical power (such, for example, as a 7½ volts to 12 volts battery). Hydraulic valves and pumps are perfectly well known and it is the function of any competent engineer to select the most suitable for his purpose and he will not need to employ the inventive faculty in making his selection. As one example of known data, reference is made to the publication entitled "Machine Design" and sub-titled "Fluid power" which is published regularly by The Penton Publishing Company of Cleveland, Ohio, USA.

In a door opener as described in any one of the four preceding paragraphs, at least the first fluid-operated means may be provided with springs which will serve to return the piston from any position to which it has been displaced in said first direction of movement thereof.

BRIEF DESCRIPTION OF THE DRAWINGS.

One embodiment of a door opener according to the present invention will now be described, by way of example only, with reference to the accompanying diagrammatic drawings, in which.

DETAILED DESCRIPTION OF PREFERRED EMBODIMENTS

Figure 1:
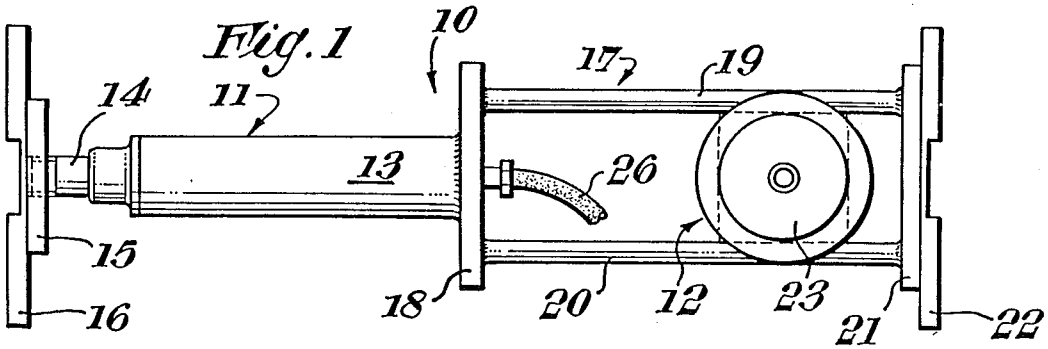
FIG. 1 is a front elevation of one embodiment of a door opener (without any spring-return capability) according to the present invention.
Figure 2:
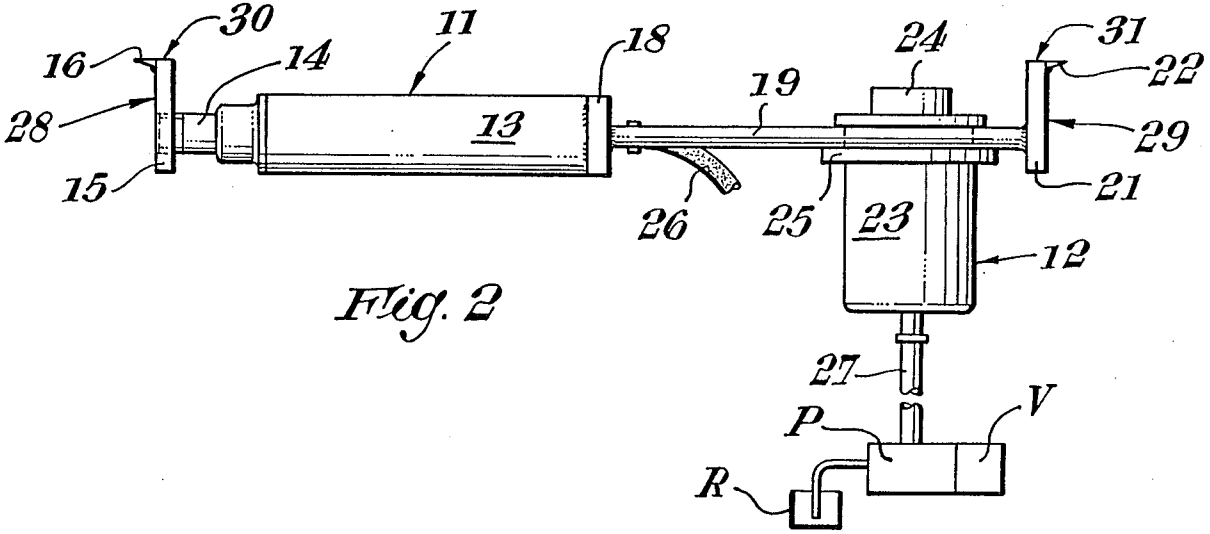
FIG. 2 is a plan view of the door opener shown in FIG. 1.

Referring briefly to FIGS. 1 and 2 of the drawings, there is illustrated a door opener 10 which comprises first fluid-operated means 11 operable to mount a second fluid-operated means 12 securely on the jambs of a door frame (not shown) in such a manner as to permit the door (which is connected by hinges and a lock to said door frame) to be moved relatively to the door frame by force (pressure) applied to the door by the securely mounted second fluid-operated means.

Said means 11 is a cylinder 13 which contains a piston (not visible) to which is attached a piston rod 14 to the free end of which there is attached a jamb-engaging element 15. In the preferred form of the door opener, the element 15 is equipped with a blade 16 (for example, welded to the element 15) which is of tapered cross-sectional shape as can be seen in FIG. 2. Mounted at that end of the cylinder 13 which is remote from the element 15 is a frame 17 which consists of a rectangular plate 18 which is welded to the cylinder 13 and which is welded to corresponding one ends of parallel bars 19,20. The corresponding other ends of said bars are welded to a rectangular element 21; in said preferred form of the door opener described above, the element 21 is equipped with a blade 22 which is also of tapered cross-sectional shape and which is preferably welded to the element 21.

The elements 15, 21 (whether supplemented by their respective blades 16, 22 or not) constitute opposed elements for engaging the opposed faces of the upright jambs of a door frame.

The second fluid-operated means 12 is securely mounted on the frame 17 in any suitable manner. As illustrated, said means 12 is cylinder 23 which contains a piston (not visible) to which is attached a piston rod or ram 24. It will generally be preferred to weld a plate (not illustrated) to the free end of the rod or ram 24 for the reason which will be explained below. The cylinder 23 carries an annular collar or flange 25 by means of which the means 12 can be securely attached to the frame 17, for example by screws, nuts and bolts or welding.

Conduits 26, 27 are appropriately connected to at least one end of the respective cylinders 13, 23 for the supply of hydraulic oil to the cylinders. Each of said conduits is connected by way of suitable valve means V (not illustrated in any detail) but well known in the art) to either a hand-operated pump or battery-driven pump P (also not illustrated in any detail). There will also be an appropriate reservoir R for the hydraulic oil. Both of the fluid-operated means 11, 12 should be operated from the same pump and should use oil from the same reservoir and should be connected to a single valve means and, therefore, although the conduit 26 is not actually illustrated as being connected to said valve means V and pump P, it will be so connected.

The operation of the door opener described above is as follows:

The door opener 10 is offered up to the closed and locked door in such a manner that the longitudinal axis of the cylinder 13 and the longitudinal axis of the frame 17 is parallel to the front surface of said door, the axially outer surfaces 28, 29 (see FIG. 2) of the elements 15, 21 facing the surfaces of the jambs and being reasonably close to said jamb surfaces. Moreover, the edge surfaces 30,31 of said elements 15, 21 (and the corresponding surfaces of the blades 16, 22 is these are provided) should be placed in contact with the door surface. The pump is then operated in order to move the element 15 away from the element 21 until both of the surfaces 28, 29 are in firm contact with the jamb surfaces. If the elements 15, 21 have been provided with the tapered blades 16, 22 these will penetrate between the door and the rebated jambs of the door frame.

Thus positioned, the element 15, the rod 14, the cylinder 13, the frame 17 and the element 21 will be firmly secured to the building structure, with the result that the second fluid-operated means 12 will be securely mounted on the jambs. Thereupon, the valve means V are operated in order to switch the hydraulic oil supply to the input for the cylinder 23 and the rod or ram 24 thereof will be moved into contact with the door. As the force (pressure) on the door increases, the door is pushed away from the door opener 10 until the hinges or the lock, or perhaps both, are unable to withstand the force (pressure) and longer, whereupon the door falls out of the door frame inwardly into the premises. As already stated above, it may well be preferred to secure a relatively large plate to the free end of the rod or ram 24 in order to spread the applied force (pressure) over as great an area of the door as possible.

It will be noticed that the second fluid-operated means 12 is mounted on the frame 17 in a position which is close to the element 21. This is the preferred position because it will be desirable to apply the force (pressure) to the door at a position which is either as close to the hinges as possible or as close to the lock as possible; the part of the door to which said force (pressure) will be applied will depend upon the positioning of the door opener at the beginning of the operation because it will be apparent that the element 21 could be on the operator's right (as shown in the drawings) or on the operator's left if the opener is placed the other way.

Figure 3:
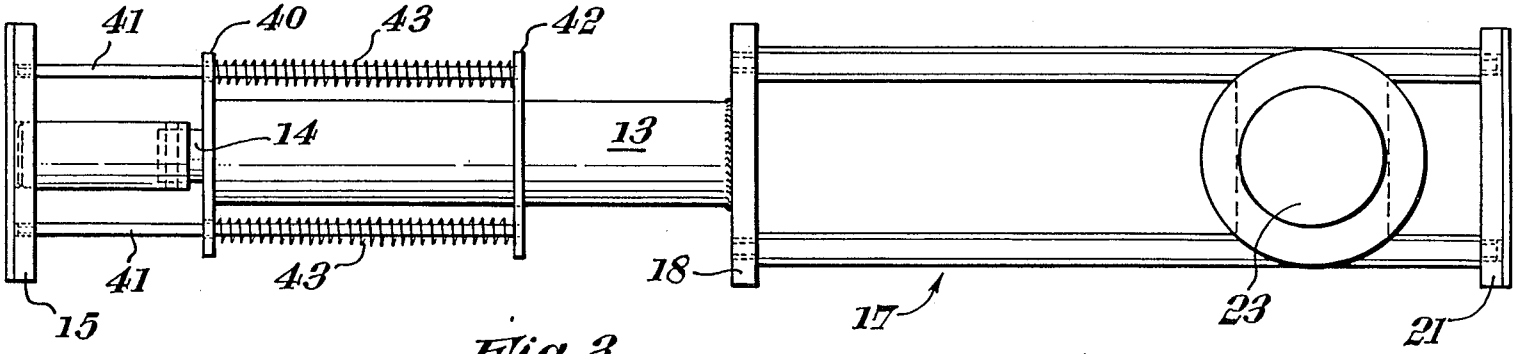
FIGS. 3 and 4 illustrate a spring-return embodiment of said door opener.
Figure 4:
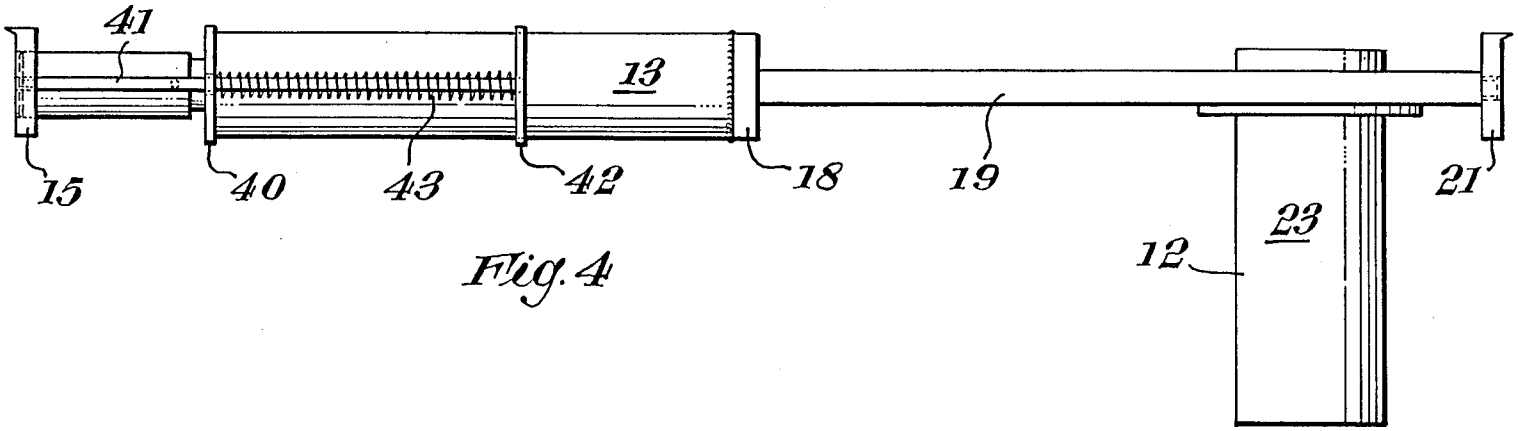

Referring to FIGS. 3 and 4, in which the same reference numerals have been used to indicate parts which are common to the two embodiments, it will be seen that the cylinder 13 is additionally provided with a plate 40 which is secured (e.g. by welding) to that end of the cylinder which is remote from the plate 18. Said plate 40 is apertured to receive a pair of rods 41 in such a manner that said rods are able to move freely relatively to the plate 40 and to the cylinder 13 in directions parallel to the longitudinal axis of said cylinder. Corresponding one ends of the rods 41 are secured to the element 15 and the corresponding other ends thereof are secured to another plate 42 which encircles the cylinder 13 with sufficient clearance to enable the plate 42 to move freely along the cylinder. A pair of compression springs 43 have their respective convolutions encircling the respective rods 41, one end of each spring bearing against the plate 40 and the other end thereof bearing against the plate 42. It will be apparent that, when the element 15 is moved to the left as viewed in FIGS. 3 and 4, the springs 43 will be compressed because the rods 41 will move the plate 42 towards the plate 40. When the cylinder 13 is vented (exhausted) by appropriate operation of the valve means V, the springs will restore the plate 42 and the element 15 to their respective starting positions.

Figure 5:
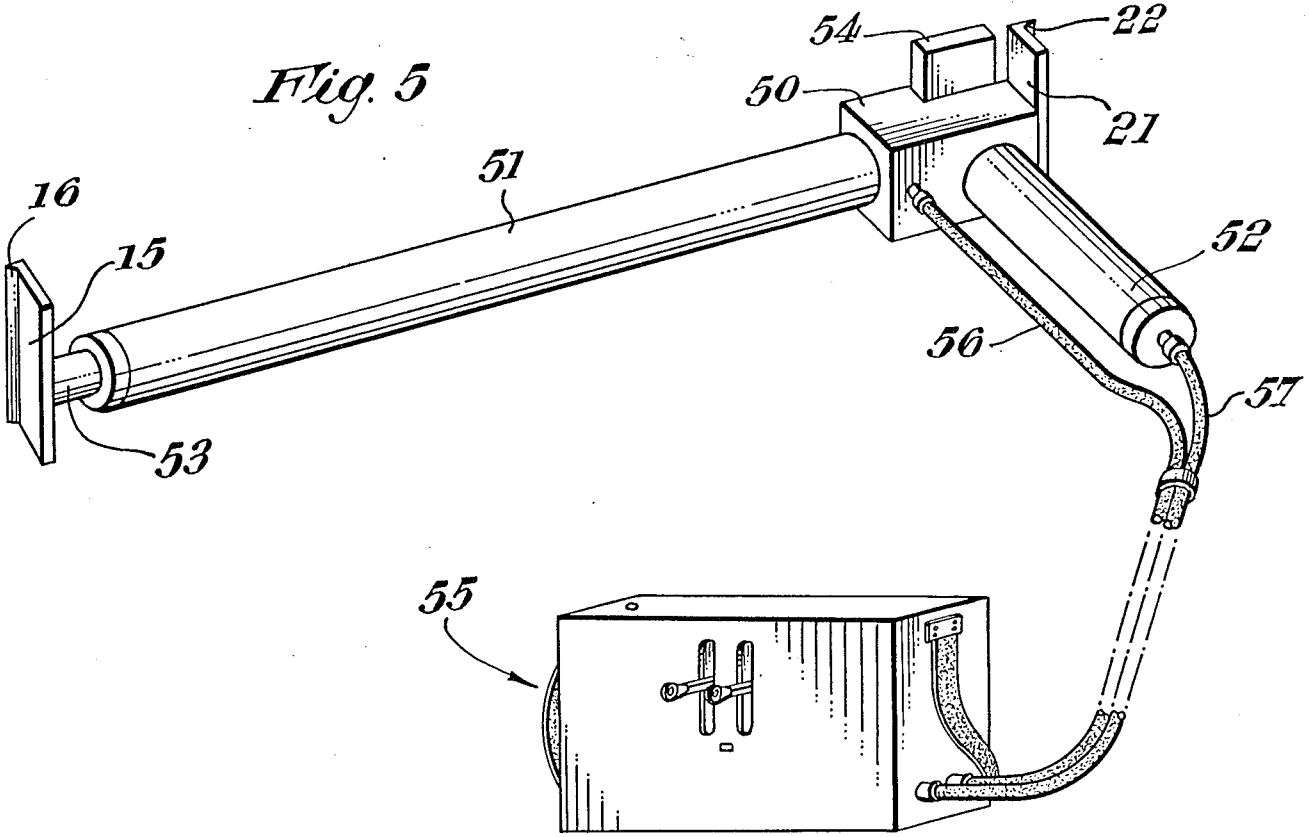
FIG. 5 illustrates an alternative to the embodiment of FIGS. 1 and 2.

In FIG. 5, there is illustrated that could be called a "cleaned up" version of the door opener of FIGS. 1 and 2. The door opener illustrated comprises a block 50 from which there extend two cylinders 51, 52. The cylinder 51 contains a piston (not visible) to one face of which is connected a piston rod 53 with its jamb-engaging element 15,16. Another jamb-engaging element 21, 22 is mounted on the block 50. The cylinder 52 which houses a piston (not visible) to which is secured a piston rod (also not visible) to the outer end of which there is connected a pressure-spreading plate 54. A complete pack 55 contains an oil reservoir, a pump and the necessary valving (none of which is visible) and said pack is easily portable. Conduits 56,57 connect the pack to the cylinder 51, 52, respectively, for the operation of said cylinders sequentially.

The cylinders 51, 52 do not contain return springs; after use of the door opener, the pistons in the cylinders are returned to their "rest" positions manually by pushing the element 15 and the plate 54, respectively. If return springs were provided, the convolutions of the springs would encircle the respective piston rods and would be housed wholly within the cylinders in this particular embodiment.

In the prototype which has been tested with great success, the first fluid-operated means 11 had a 1 inch (25.4 mm) diameter rod 14 and a stroke of 5 inches (127 mm), and the second fluid-operated means 12 had a 2 inches (50.8 mm) diameter rod or ram 24 and a stroke of $2\frac{1}{2}$ inches (63.5 mm).

In the testing of the prototype, a securely locked door was opened, virtually silently, in approximately 20 seconds, this being the time taken over the entire operation.

What is claimed is:

1. A door opener comprising a rectangular block having six faces of which four faces are interrupted by a plane which is parallel to and located between the two remaining faces;

first and second hydraulic actuators adapted to produce linear motion and each including a piston housed in a cylinder and a piston rod connected to the piston and extending through one end of the cylinder to provide a free end;

two jamb-engaging elements;

one of said jamb-engaging elements being connected to the free end of the piston rod of said first hydraulic actuator;

the cylinder of said first hydraulic actuator extending outwardly from a first face of said four faces of the block;

the other of said jamb-engaging elements being mounted on a second face which is opposite to said first face of the block;

the cylinder of the second hydraulic actuator extending outwardly from a third face which is adjacent to said first face and to said second face of the block;

a door-engaging member;

the piston rod of said second hydraulic actuator extending through said block towards and through the fourth of said four faces of said block;

said door-engaging member being connected to said free end of the piston rod of said second hydraulic actuator; and means operable to supply a liquid under pressure to each of the hydraulic actuators in turn;

whereby operation of the first hydraulic actuator causes the jamb-engaging elements to engage the door jambs and, subsequently, operation of the second hydraulic actuator causes the closed/-locked door to be pushed out of the doorway.

* * * * *